United States Patent [19]

Sutter

[11] Patent Number: 5,031,888

[45] Date of Patent: Jul. 16, 1991

[54] HOLDING DEVICE

[76] Inventor: Robert J. Sutter, Rte. 2, Box 264A, Braham, Minn. 55006

[21] Appl. No.: 474,143

[22] Filed: Feb. 2, 1990

[51] Int. Cl.[5] ..... B25B 1/08

[52] U.S. Cl. ..... 269/231

[58] Field of Search ..... 269/231, 235, 158, 285

[56] References Cited

U.S. PATENT DOCUMENTS

| | | | |
|---|---|---|---|
| 630,900 | 8/1899 | Kohl | 269/231 |
| 1,372,128 | 3/1921 | Metcalf et al. . | |
| 2,491,972 | 12/1949 | Halote | 269/158 |
| 3,400,926 | 9/1968 | Stoltz | 269/231 |
| 3,689,059 | 9/1972 | Gross | 269/158 |
| 4,222,490 | 9/1980 | Wood | 269/235 |
| 4,767,131 | 8/1988 | Springer et al. | 269/231 |

*Primary Examiner*—Robert C. Watson

*Attorney, Agent, or Firm*—Lawrence M. Nawrocki

[57] ABSTRACT

A device (10) for holding a sheet-like item during, for example, a folding operation. The device (10) includes a finger (46) having an engagement surface (74) defined by an engagement portion (60) of the finger (46). A jaw (76) is eccentrically mounted for rotation between a position in engagement with the surface (74) and a position wherein the jaw (76) is spaced from the surface (74). The jaw (76) is biased toward the engagement position.

8 Claims, 1 Drawing Sheet

HOLDING DEVICE

TECHNICAL FIELD

The present invention deals broadly with structures for holding thin, sheet-like items. More narrowly, however, the apparatus is intended for use as a laundry folding accessory having a jaw mechanism for clamping a sheet therein. A preferred embodiment of the invention includes a jaw mechanism for facilitating insertion of a sheet thereinto.

BACKGROUND OF THE INVENTION

The commercial laundering of large flatwork can present troublesome problems. Typically, after laundering is completed, items such as sheets are folded into a more compact configuration. When two or more persons are available, folding can be accomplished relatively easily. The cooperation of pairs of individuals enables the process to go smoothly and quickly.

In institutional and public laundries, it is the rule rather than the exception that a plurality of employees are available to effect folding. Even when this is the case, however, much more can be accomplished if folding could be performed by one individual. If, for example, four employees are tasked with the job of folding sheets, substantially twice the output can be obtained if they were divided up into four teams, each having one person, than if they were divided into two teams, each having two persons. The problem is even further accentuated in a residential environment. Typically, only one person is available at most times to effect folding of sheets.

Various proposals have been made to provide holding accessories in order to render folding of sheets more facile. The proposals, however, are subject to numerous deficiencies and disadvantages. Probably the most recent advance in this technology is that illustrated in U.S. Pat. No. 3,689,059 (Gross). That patent issued for an invention entitled LAUNDRY FOLDING ACCESSORY. The apparatus illustrated therein has a normally closed clamping jaw. The jaw is disposed for reciprocal vertical movement between an upper position, in which the clamping jaw engages a fixed jaw to hold, for example, a sheet therebetween, and a lower position, in which the clamping jaw is spaced downwardly from the fixed jaw. The clamping jaw is mechanically linked to foot manipulatable means, and downward force applied to a stirrup translates into corresponding downward movement of the clamping jaw.

When an individual is operating the Gross apparatus, the person engages his foot with the stirrup and urges the stirrup downwardly. With the clamping jaw retracted downwardly, an edge of the sheet is inserted between the jaws. With the edge of the sheet so disposed, the stirrup is released, and the clamping jaw moves upwardly under the influence of upwardly biasing force to hold the sheet between the two jaws. When the sheet has been folded sufficiently, the stirrup is again engaged in order to release the sheet. The sheet is, thereafter, withdrawn from a position between the jaws.

While the Gross device is an improvement over previous structures, it still retains shortcomings. As is apparent in the description above, foot manipulation is required not only to remove the sheet from the position between the jaws, but also to allow the jaws to be retracted relative to one another in order to enable insertion of the edge of the sheet into position so that it can be grasped by the jaws.

The inability to insert a sheet between two jaws to be grasped thereby without required foot manipulation of the grasping apparatus can dramatically slow down the folding process. The lost time can, in commercial scenarios, translate into lost revenues.

It is to these dictates and shortcomings of the prior art that the present invention is directed. It is an improved holding device which solves many of the problems existent in the prior art.

SUMMARY OF THE INVENTION

The present invention is a device for holding a sheet-like item, for example, so that the item can be folded by one individual. The device includes a member which defines a surface against which the item is held. A jaw is pivotally mounted so that it is moveable between a clasping position wherein it engages the surface against which the sheet-like item is to be held, and a position spaced from the engagement surface so that the sheet-like element can be admitted between the jaw and the surface. The jaw is normally biased to the clasping position, and means, remote from the jaw, are provided to effect pivoting of the jaw away from the clasping position.

The surface against which the sheet-like element is to be held can be defined by a downwardly-extending, elongated finger. In the preferred embodiment of the invention, a distal end of the finger is encased with a sleeve which can be formed from an elastomeric material having a high coefficient of friction. By providing such a sleeve, slipping of the sheet-like item out of the grip of the jaw and the surface against which it is engaged is retarded.

Certainly, a number of elastomeric substances are appropriate for the sleeve. Various types of rubber have, however, been found to be particularly effective in functioning as the sleeve.

In the preferred embodiment, the jaw takes the form of an eccentrically-mounted, disk-like structure which is pivotable about a generally horizontally-disposed axis. Such a jaw is biased downwardly, under the influence of gravity, into its clasping position wherein a convex surface of the jaw engages the sleeve which encases the distal end of the finger. In that embodiment, the disk-like jaw has a pair of generally parallel side faces, the axis about which the jaw is mounted for pivoting being generally perpendicular to these faces.

In the preferred embodiment also, the jaw and sleeve-encased finger with which it cooperates are mounted proximate an upper end of a support. The height of the support would be such that the upper end at which the jaw and finger are mounted would be at a height accessible to a person operating the device.

The device can be provided with a foot pedal pivotally mounted proximate the lower end of the support. A linkage bar can be disposed to interconnect the jaw and foot pedal so that, as the foot pedal is depressed, the linkage bar effects pivoting of the jaw away from its clasping position.

The present invention is, thus, an improved device for holding sheet-like items such as laundry flatwork. More specific features and advantages obtained in view of those features will become apparent with reference to the DETAILED DESCRIPTION OF THE IN- VENTION, appended claims, and accompanying drawing figures.

DETAILED DESCRIPTION OF THE INVENTION

Figure 1:
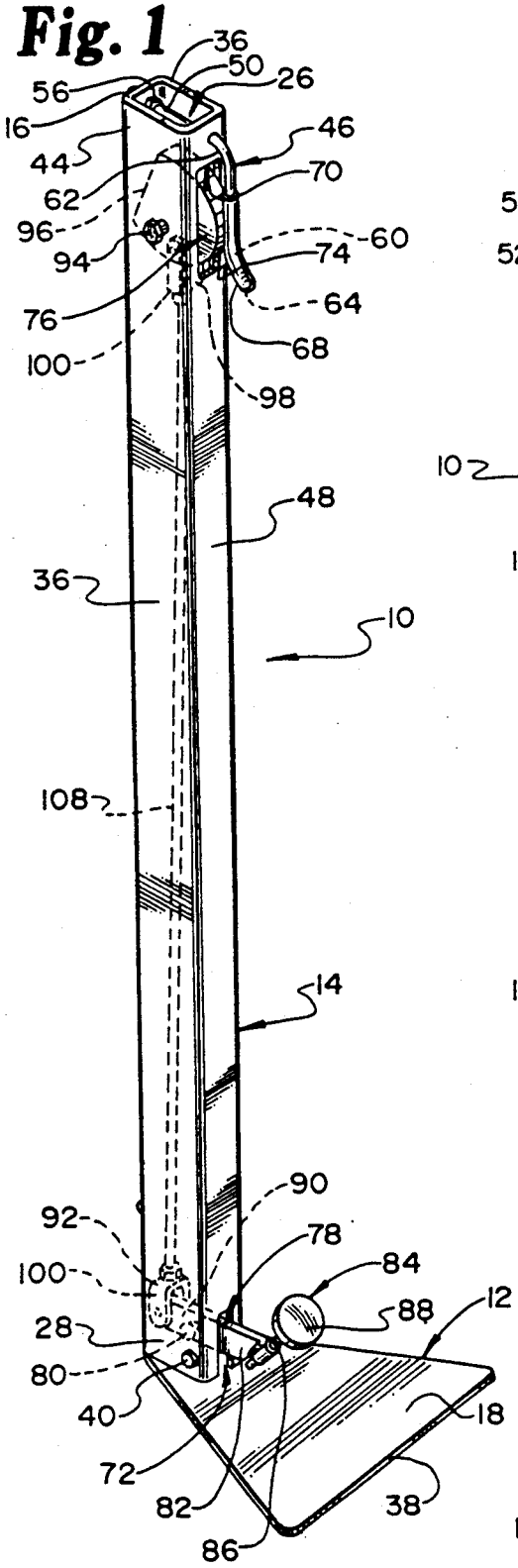
FIG. 1 is a perspective view of a structure in accordance with the present invention.

Referring now to the drawing wherein like reference numerals denote like elements throughout the several views, FIG. 1 illustrates the preferred embodiment of a holding device 10 for use in, for example, folding sheets, other flatwork, and sheet-like items (not shown). The device 10 includes a base 12 to which is mounted a generally vertically-extending support 14. The base 12 in the figures is illustrated as being substantially triangular in shape. Additionally, the base 12 is shown as extending primarily forward of the support 14. It is envisioned that a base 12 so extending functions better than one which extends, to any significant degree, rearwardly from the support 14. As will become apparent hereinafter, the force exerted upon the support 14 would tend to tip the device 10 in a forward direction, so a forwardly-extending base 12 would give the device 10 greater stability. It will be understood, however, that bases having shapes other than triangular and extending in multiple directions, concurrently, from the support 14 are specifically envisioned as being within the scope of the invention.

Embodiments of the invention are, in fact, contemplated wherein no base whatsoever is provided. In such embodiments, any support forming part of the device 10 could be mounted to a wall (not shown) or suspended in a vertical orientation in some other appropriate manner.

Further, it will be understood that the specific support 14 shown in the drawing figures is only illustrative. Supports structured differently (for example, one without a rear wall 16 for use in embodiments wherein the support 14 is mounted directly to a wall of the space in which the device 10 is to be used) are also contemplated.

In the embodiment illustrated, however, the support 14 is shown as being mounted semi-permanently to the base 12. This is accomplished by providing the base 12 with one or more padeyes which extend generally vertically from the main body portion 18 of the base 12. A long padeye 20 is intended to overlie a relatively significant portion of the rear wall 16 of the support 14. This padeye 20 is provided with an aperture 22, as is the rear wall 16, and these apertures 22, 24 are disposed in their respective components so that, when the support 14 is placed over the padeye 20, the apertures 22, 24 will be in registration. It will, of course, be understood that the padeye 20 is sized, in a horizontal direction, so that it can fit within a channel 26 within the support 14 when the support 14 is sought to be placed over the padeye 20 with the lower end 28 of the support 14 in engagement with the main body portion 18 of the base 12.

With the apertures 22, 24 in registration, a bolt 30 can be passed therethrough and a nut 32 tightened down onto the threaded shank portion of the bolt 30 to hold the support 14 to the base 12. While only one bolt/nut combination is shown as passing through the padeye 20 and the rear wall 16 of the support 14, multiple bolt/nut combinations can be employed if more secure attachment is desired, and only then so long as the securing means does not obstruct operation of the invention as will be discussed hereinafter.

The figures illustrate a shorter pair of padeyes 24 as being positioned on the base 12 forward of the rear padeye 20 and in positions so that, when the support 14 is placed over the rear padeye 20, the shorter padeyes 34 will engage side walls 36 of the support 14. The positioning of the padeyes 34 would, of course, be so as to angularly orient the support 14 relative to the base 12. That is, the positioning of the side padeyes 34 could be such so as to dispose the support 14 generally perpendicular to a front edge 38 of the base 12.

As in the case of the rear padeye 20, the side padeyes 34 are shown as being provided with apertures therethrough. These apertures, in turn, are made to be registered with corresponding apertures in the side walls 36 of the support 14. Again, bolt/nut combinations 40 can be used to secure the support 14 to the side padeyes 34 by passing a bolt through each set of corresponding apertures and tightening a nut down on the threaded shank of the bolt.

It will be understood that both the side and rear padeyes 20, 24 can be secured to the base 12 in any appropriate manner. The figures illustrate affixation having been effected by welding, as at 42.

The support 14 is shown as being manufactured from rectangular cross-section stock. As previously discussed, however, this is not an exclusive structure for the support.

The support 14 would be of an appropriate length so that the upper end 44 is easily accessible to a person using the device 10. As will be discussed hereinafter, however, the device 10 is intended to be employed, for example, in folding sheets. Consequently, the upper end 44 of the support 14 should be sufficiently high off the floor so that, considering the dimensions of the sheet, the sheet will not drag on the floor when grasped by the device 10 in a manner that will be discussed hereinafter.

Figure 2:
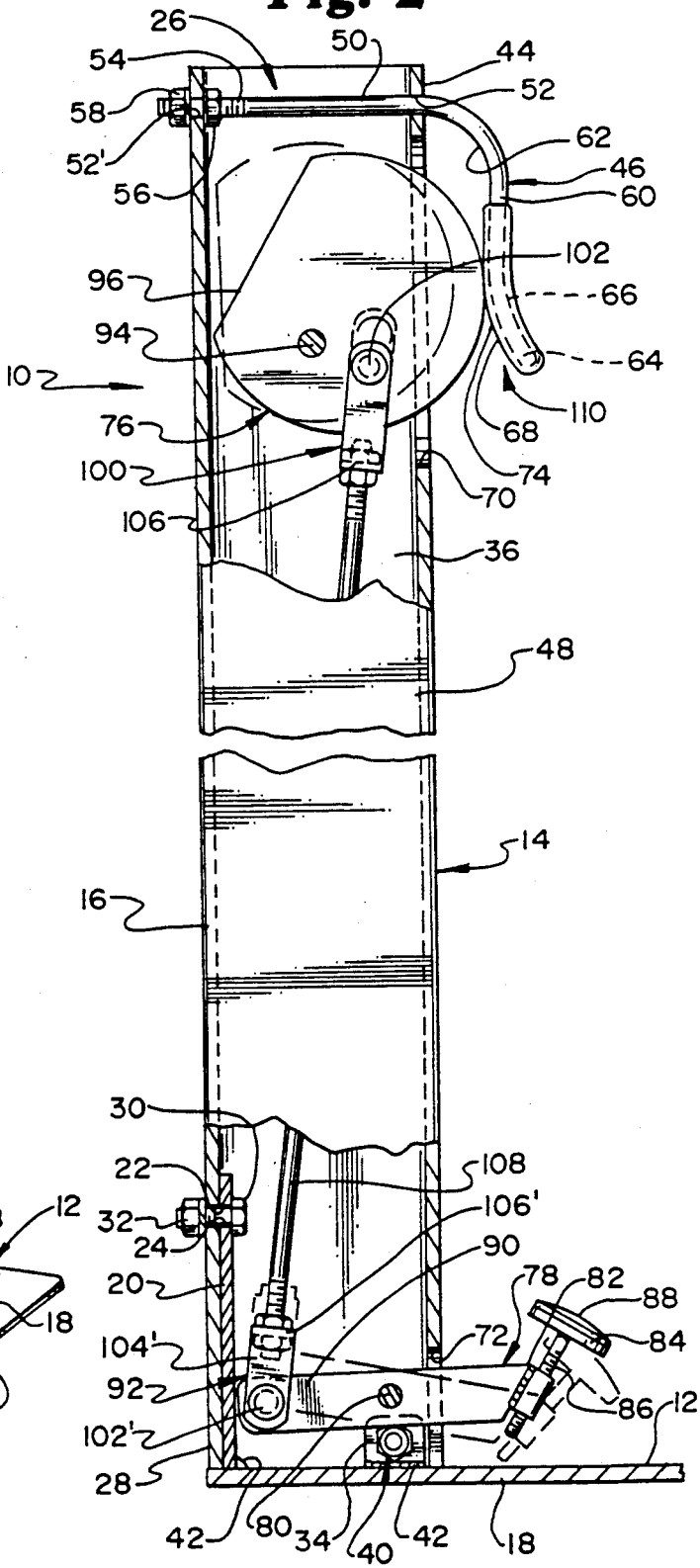
FIG. 2 is a shortened side-elevational view with some parts broken away, and parts shown in alternate positions.

The figures illustrate an elongated finger 46 extending downwardly from the front wall 48 of the support 14 proximate the upper end 44 thereof. FIG. 2 best illustrates a manner in which the finger 46 can be so mounted. The finger 46 could be manufactured from a length of stock so that the overall finger 46 includes a substantially straight portion 50 which can be made to extend through registered apertures 52, 52′ in the front and rear walls 48, 16 of the support 14.

The straight portion 50 can be provided, at its distal end, with threading, as at 54. A first nut 56 can be threaded onto the distal end of the straight portion 50 after that portion 50 has been inserted through the aperture 52 in the front wall 48. The threaded shank is, thereafter, inserted through the aperture 52′ in the rear wall 16, and a second nut 58 is tightened down on the threading 54 in order to secure the straight portion 50 of the finger 46 at a particular longitudinal location relative to the support 14. As will be seen in view of this disclosure, the spacing of the downwardly-depending finger engagement portion 60 relative to the front wall 48 of the support 14 can, thereby be varied.

The downwardly-depending portion 60 of the finger structure 46 is formed by bending the finger stock at substantially 90° relative to the straight portion. The radiused bend 62 is at a location relative to the threaded shank of the straight portion 50 so as not to preclude the shank portion threading 54 from extending sufficiently far through the support 14 wherein it cannot be tightened down in position. The straight portion 50 will also be sufficiently short so that the downwardly-depending finger engagement portion 60 will not be too far forward of the front wall 48 of the support 14.

The figures illustrate, at the lower end 64 of the finger engagement portion 60, a radiused bend 66 in a direction opposite that which effects the downward extension 60 of the finger 46. That is, the lower end 64 of the finger portion 60 will be curved slightly away from the front wall 48 of the support 14. By so constructing the finger 46, insertion of the sheet during operation of the device 10 will be facilitated.

The lower end 64 of the finger portion 60 depending downwardly relative to the support 14 is shown as being encased within a sleeve 68. Various materials can be used to make this sleeve 68, but it has been found that various types of rubber have been particularly effective. In any case, however, the material employed would be one having a high coefficient of friction. The sheet held by the device 10 will, thereby, be retarded from sliding out of the grasp of the device 10, as will be discussed hereinafter.

The front wall 48 of the support 14 is provided with windows 70, 72 proximate the upper and lower ends 44, 28 thereof. The upper window 70 is at a location generally at a height the same as an engagement surface 74 of the high coefficient of friction sleeve 68 encasing the depending finger portion 60. The window 70 permits a jaw 76, pivotally mounted in the channel 26 within the support 14, to exit from the channel 26 and come into engagement with the surface 74 defined by the sleeve 68.

The lower window 72 accommodates external extension of a bellcrank-type device 78. The bellcrank 78 is pivotally mounted for rotation with respect to a shaft 80 journalled between the side walls 36 of the support 14. An outer end 82 of the bellcrank 78 is provided with a foot pedal 84. The pedal 84 can be adjusted longitudinally along its shaft 86, and relative to the bellcrank 78 so as to dispose the pedal surface 88 at a desirable height.

The inner end 90 of the bellcrank 78 carries a fitting 92 which is free to swivel relative to the bellcrank 78. As will be able to be seen, downward movement by application of foot pressure to the pedal 84, from a primary position illustrated in solid line in FIG. 2 to a second position illustrated in phantom line of FIG. 2, will translate into vertical upward movement of the fitting 92 carried by the inner end 90 of the bellcrank 78.

A jaw 76, shown as comprising a generally disk-like member, is mounted for rotation within the support 14 proximate the upper end 44 thereof. The jaw 76 rotates about the axis of a generally horizontal shaft 94 journalled between the side walls 36 of the support 14.

The figures illustrate the jaw 76 as having one faceted side, as at 96. In a normal position of the jaw 76, the faceted side 96 thereof is at an angle oblique to the rear wall 16 of the support 14. As the jaw 76 is rotated about its axis of rotation in a direction counterclockwise, as shown in FIG. 2, the faceted side 96 of the jaw 76 eventually achieves an orientation generally parallel to the rear wall 16 of the support 14. As such rotation occurs, a convex surface 98 of the jaw 76 extending through the upper window 70 in the front wall 48 of the support 14 is rotated from the solid line position, upwardly and rearwardly, to the phantom line position.

As best seen in FIG. 2, the convex surface 98 of the jaw 76 is, in the solid line position, in engagement with the surface 74 of the sleeve 68 encasing the lower end 64 of the finger portion 60. This position is defined as a clasping position, since, when the jaw 76 is in this position, a sheet can be clasped between the jaw 76 and the finger portion 60. As the jaw 76 is rotated counterclockwise, the convex surface 98 will be moved away from the finger portion 60. This is so, since the jaw 76 is eccentric.

With the jaw 76 in the clasping position, a sheet can be held securely between the jaw 76 and the finger portion 60. This is so for a number of reasons. First, as previously discussed, the sleeve 68 is made of a material which has a high coefficient of friction. As a result, movement of the sheet relative to the sleeve 68, when the jaw 76 urges the sheet into tight engagement with the sleeve 68, will be difficult.

Further, as an operator of the device 10 might tug upon the sheet, such tugging will have the effect of drawing the jaw 76 into even tighter engagement, since the frictional interface between the sheet and the jaw 76 will tend to preclude completely free sliding of the sheet relative to the jaw 76. The tighter the jaw 76 bears upon the finger portion 60, the more tightly the sheet will be held therebetween.

The jaw 76, at a location between the shaft 94 with respect to which it pivots and the front wall 48 of the support 14, is provided, as in the case of the bellcrank 78, with a pivotally mounted fitting 100, 100'. Fitting 100, as is true with the fitting 100' mounted to the inner end 90 of the bellcrank 78, can be made in a generally U-shape. In the case of each fitting, a pin 102, 102' can be passed through registered apertures in the legs 104, 104' of the U-shaped fitting 100, 100' and a corresponding aperture in one of the jaw 76 and the inner end 90 of the bellcrank 78. Corresponding fittings are, thereby, mated to their related structure without precluding the swivelling of the fittings 100, 100'. The pins 102, 102' can be held in place by any appropriate means.

An interconnecting bail 106, 106' of each U-shaped fitting 100, 100' is also provided with an aperture. One end of a linkage bar 108 is inserted through each of these apertures. The ends of the linkage bar 108 are threaded, and a location along the threaded end at which the bar 108 is secured to the respective jaw fitting 100 and bellcrank fitting 100' can be varied. The variation can be effected in the same manner as that in which the finger structure 46 is adjusted in forward-/rearward directions relative to the support 14. The linkage bar 108 is, of course, of an approximate length so that the bar 108 can interconnect the jaw and bellcrank fittings 100, 100'. Adjustability is provided to afford fine-tuning.

As previously indicated, the normal position of the jaw 76 is that shown in solid line in FIG. 2. Because of the structural relationship of the jaw 76, jaw U-shaped fitting 100, linkage bar 108, bellcrank U-shaped fitting 100', bellcrank 78, and foot pedal 84, the corresponding "normal" position of the foot pedal 84 will be the "up" position shown in solid line in FIG. 2. The jaw 76 is biased to its normal position in engagement with the finger portion 60. In the embodiment shown in the figures wherein the jaw 76 is biased downward, biasing can be accomplished by gravity.

It will, of course, be seen that, if the foot pedal 84 were extremely heavy relative to the jaw 76, there might be a tendency for the foot pedal 84 to be drawn downwardly at the expense of the jaw 76 moving upwardly. The normal sizes and weights of the materials from which the foot pedal 84 and jaw 76 are made, however, accomplish the opposite effect. That is, the jaw 76 will tend to assume the position, under the influence of gravity, illustrated in solid line in FIG. 2. In any case, however, if desirable or necessary, the forward end of the convex surface 98 of the jaw 76 could be weighted.

It will be understood that the invention is envisioned as being broad enough to encompass devices oriented different than that shown in the drawing figures. For example, a device 10 could be provided where, in fact, the jaw 76 might be biased to an upward position rather than one downward. In such an embodiment, however, special biasing means would be necessary.

In operation, a user of the device 10 would not need to manipulate the foot pedal 84 to insert a sheet. The edge of the sheet to be held would merely be urged into the nip 110 between the jaw 76 and the finger portion 60. As increased upward pressure is brought to bear upon the jaw 76, the downward gravity biasing will be overcome, and the jaw 76 will be pivoted in a counterclockwise direction away from the finger portion 60. Continued upward movement of the sheet will place the edge of the sheet into a position relative to the jaw 76 so that, if the sheet were released, it would draw the jaw 76 downwardly into tight engagement with the finger portion 60 to hold the sheet tightly therebetween.

The foot pedal 84 would, of course, have to be manipulated in order to release the sheet. The operator would have to press the pedal 84 in order to rotate the jaw 76 away from the finger portion 60 and hold the jaw 76 at a position at a sufficient distance from the finger portion 60 so that the sheet can be withdrawn. Significant time and effort, however, are saved during the sheet insertion step.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. Apparatus for holding a sheet-like item, comprising:

(a) a member defining a generally vertically-extending engagement surface;

(b) an eccentric jaw pivotally mounted for movement between a clasping position in contact with said engagement surface, and positions pivoted upward and away from said engagement surface; and (c) means normally biasing said jaw to said clasping position.

2. Apparatus in accordance with claim 1 wherein said member comprises a downwardly-extending, elongated finger having a distal end encased within a sleeve formed from a material having a relatively high coefficient of friction.

3. Apparatus in accordance with claim 2 wherein said material encasing said finger of said member is rubber.

4. Apparatus in accordance with claim 2 wherein said eccentric jaw is pivotable about a generally horizontally-disposed axis downwardly into said clasping position, and wherein a convex surface of said jaw contacts said sleeve encasing said distal end of said finger.

5. Apparatus in accordance with claim 4 wherein said jaw includes opposite, generally parallel faces, and wherein said axis about which said jaw pivots is generally perpendicular to said faces.

6. Apparatus in accordance with claim 1 wherein said jaw is biased to said clasping position by gravity.

7. Apparatus in accordance with claim 1 further comprising means, remote from said eccentric jaw, for pivoting said jaw away from said clasping position, and wherein said pivoting means comprises a foot pedal and a linkage bar interconnecting said foot pedal and said jaw, and wherein depression of said foot pedal effects pivoting of said jaw away from said clasping position.

8. Apparatus for holding a sheet-like item, comprising:

(a) an elongated, generally vertically-extending support having upper and lower ends;

(b) a downwardly-extending, elongated finger mounted to said support proximate said upper end thereof;

(c) an eccentric jaw pivotally mounted to said support proximate said upper end thereof, said jaw being pivotally disposed for movement between a clasping position in engagement with said finger, and positions spaced from said finger, wherein said jaw is biased by gravity downwardly to said clasping position;

(d) a foot pedal pivotally mounted to said support proximate said lower end thereof; and (e) a linkage bar interconnecting said foot pedal and said jaw;

(f) wherein depression of said foot pedal effects pivoting of said jaw away from said clasping position.

* * * * *